US005152089A

United States Patent [19]

Bellico

[11] Patent Number: 5,152,089

[45] Date of Patent: Oct. 6, 1992

[54] MULTI-IMAGE SIGN DISPLAY EMPLOYING PHOTOGRAPHIC TYPE IMAGES

[75] Inventor: Ernie Bellico, Ozone Park, N.Y.

[73] Assignee: Burson-Marstellar, New York, N.Y.

[21] Appl. No.: 602,351

[22] Filed: Oct. 23, 1990

[51] Int. Cl.[5] ..... G09F 13/00

[52] U.S. Cl. ..... 40/443; 40/442

[58] Field of Search ..... 40/442, 443, 444, 219, 40/615, 900

[56] References Cited

U.S. PATENT DOCUMENTS

| | | | |
|---|---|---|---|
| 2,118,320 | 5/1938 | McEwin | 40/443 |
| 2,221,887 | 11/1940 | White | 40/219 |
| 2,225,307 | 12/1940 | Kreeger | 40/443 |
| 3,017,713 | 1/1962 | Butler | 40/900 |
| 3,694,945 | 10/1972 | Detiker | 40/615 |
| 3,745,678 | 7/1973 | Thomassen | 40/442 |

*Primary Examiner*—James R. Brittain
*Assistant Examiner*—Cassandra L. Hope
*Attorney, Agent, or Firm*—Bryan Cave

[57] ABSTRACT

A multi-image sign display (10,100) controllably interrelates a pair of controllable illumination means (22,24), for providing different selectable media effects from first and second displayable scenes (14,16) dependent on the first and second lighting effects which enable a controllable display of the second scene (16) visually perceptible through the first scene (14) dependent on these effects, such as a visually perceptible cross-dissolve effect, ort a full on/full off effect. The images (14,16) are continuous tone photographic images which comprise a trans/opaque matrix (12) sandwich-type image (14,16) consisting of a light transmitting substrate (30) having a film layer (28) applied thereto in which the front (14) and rear (16) images are segmented images, with the front reflective image areas (14) being interspersed between the transparent rear image areas (16) and having opaque white backing layers (18) therebehind to provide a vertically striped grid (32) which is mounted in a light box assembly (20) which may be used separately, or which a plurality of adjacent light box assemblies (**20*a*–20*l*) to provide a composite sign display (100), such as one mounted on the exterior (56**) of a building.

30 Claims, 4 Drawing Sheets

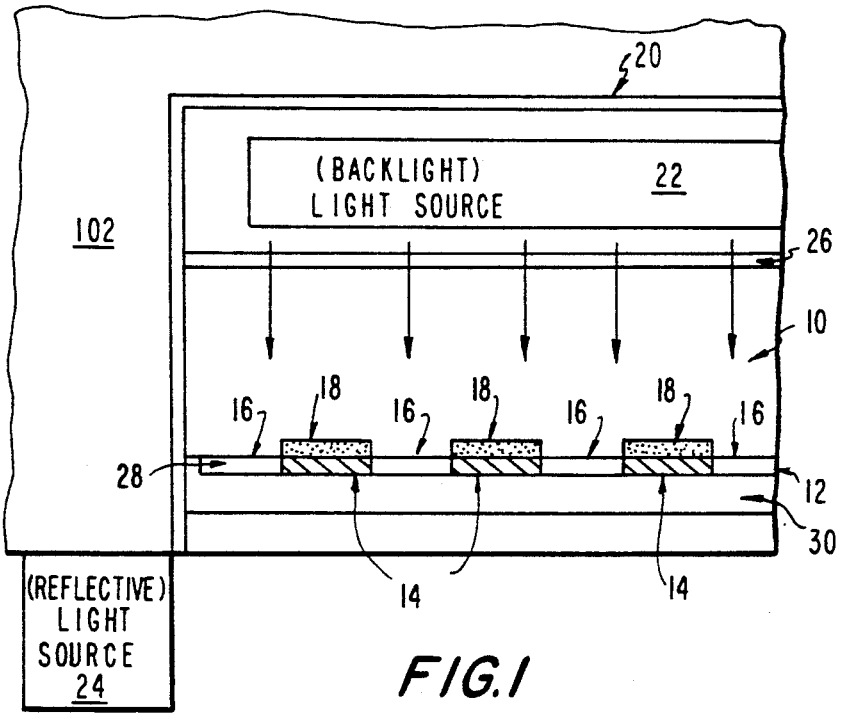
FIG. 1
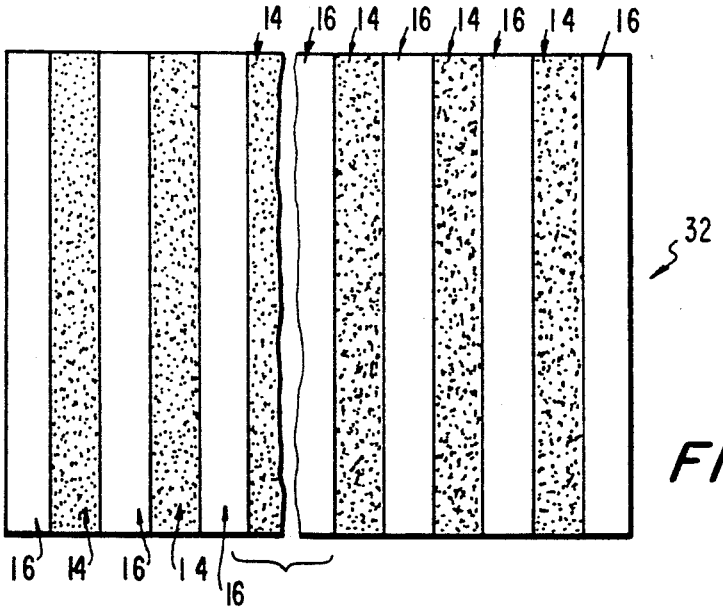
FIG. 2
FIG. 3
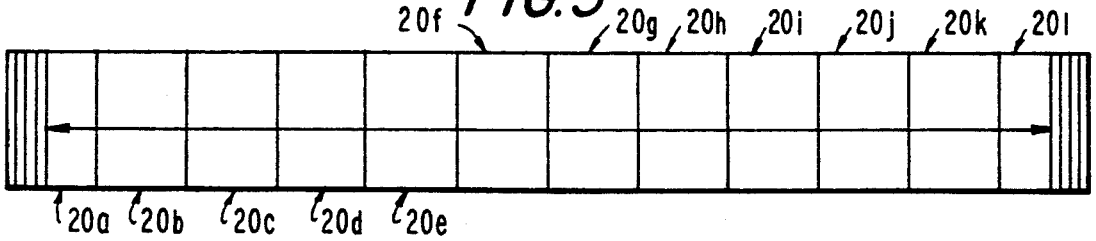

MULTI-IMAGE SIGN DISPLAY EMPLOYING PHOTOGRAPHIC TYPE IMAGES

TECHNICAL FIELD

The present invention relates to sign displays for providing various display messages, and particularly to such sign displays which employ photographic images.

BACKGROUND ART

Sign displays have existed in the art for many years and have become more and more sophisticated with the growth in technology. Such sign displays, particularly for outdoor advertising, have involved various media such as neon, television, and animated graphics. In addition, such prior art sign displays known to applicant have involved the use of multiple media in order to provide a display message. For example, in 1985, in Tsukuba, Japan, a multi-media theater show exhibit employed an interior application of a perforated vinyl front projection surface which was used for a laser and slide display in a reflection mode, in combination with a video wall which was mounted behind the perforated surface and was visible through the perforations of the projection surface in a transmission mode. The video wall covered a small segment of the entire perforated surface, such as approximately thirty percent, and the display switched between the front projection of lasers and slides and the video wall which was displayed through a section of the perforated material. The images, however, were not continuous tone photographic images and the mediums employed were separate and distinct different mediums and did not provide a plurality of different selectable media effects from two different displayable scenes dependent on two different lighting effects which were selectively controllable to selectively illuminate the separate display areas.

Another prior art system was employed by applicant's assignee at the Calgary Winter Olympics in 1988 in which an exterior application which consisted of a perforated metal surface or metal skin which displayed a painted on work of art in the reflection mode was employed. This front surface was illuminated at dawn, at dusk, and at night. Located behind the perforated surface, again, was a video wall, and two light boxes occupying a segment of the total area, such as approximately 50 percent in the transmission mode. In this arrangement, the perforated surface was displayed during the day, while during the evening performance the video wall and light boxes were featured. Again, as in the Tsukuba arrangement, the images were not continuous tone photographic images and there were separate and distinct different kinds of art and media and the two scenes were not integrated due to different lighting effects.

Moreover, in the prior art sign displays known to applicant it was costly to produce the separate and distinct different kinds of art and media and the displays could not readily be changed if, for example, it was desired to substitute new advertising messages in the sign display. In addition, if used as outdoor signage, such signage is usually viewed at a high angle, such as about 45 degrees, at which perforated circular holes are perceived as narrow ellipses or horizontal slits thereby reducing the visibility of the transparent back image. This is overcome in the present invention by the use of a vertical stripe-like format that allows full visibility of both front and back lighted images. Moreover, in accordance with the present invention, in which a light transmitting substrate is employed involving a matrix system that combines both a reflective front image and a transparent rear image in one layer, such as by double exposing conventional photographic film based material through a positive and a negative template in order to combine both images into a single layer, both the front and rear images are the same type of art, namely continuous tone photographic art, providing further advantages over the prior art, such as the ability to change the art quickly and the ability to simulate digital video effects using still photographic media, such as by segmenting both the front and rear image into identical modules and employing a computer based control system to switch between front and rear illumination. Thus, the present invention provides several advantages over the prior art particularly with respect to increased flexibility, ease of use, and the ability to combine various media effects in a dynamic manner.

DISCLOSURE OF THE INVENTION

A multi-image sign display comprises a light transmitting substrate with a film media contiguously disposed thereon for providing a laminated sandwich type arrangement comprising the two scenes or images, both of which preferably comprise continuous tone photographic images. Each of the images comprises a plurality of spaced apart image areas, with the transmissive image areas being interspersed between the reflective image areas, and with an opaque white backing layer comprising a plurality of spaced apart opaque areas being disposed behind the reflective image areas. The reflective photographic image is preferably at least 200% lighter than the transmissive photographic image which is preferably a normally exposed photographic image so that, for example, the reflective photographic image may be viewed in daylight while the transmissive photographic image may be viewed at night. By way of example, the sign display may comprise a light box in which there is a vertical grid composed of the alternating reflective image and transmissive image areas, in which, in a 44 inch×44 inch light box, there would be 176 lines, comprised of 88 vertical stripes of transmissive image areas ¼ inch wide and 88 vertical stripes of opaque white backed reflective image areas ¼ inch wide. If desired, multiple light boxes can be placed together to make an even larger display, such as 12 such light boxes running horizontally to provide a total of 2,112 vertical lines.

Controllable illumination sources may be provided to illuminate the film media from the front side for providing a reflective lighting condition for enabling a controllable display of the front reflective image first scene or from the rear side for providing a rear illumination or back lighting condition for the film media for enabling a controllable display of the rear transmissive image second scene visually perceptible through the front reflective image first scene. Preferably a white light diffuser is disposed between the back light source and the film media. In this manner, different scenes and effects may be employed in a multi-image sign display using continuous tone photographic images in which the visible scenes and effects are dependent on controlled lighting conditions. If desired, such a multi-media sign may be used in an advertising display by itself, or integrated with other advertising media or signage, such as on the exterior of a building.

BRIEF DESCRIPTION OF THE DRAWINGS

FIG. 1 is a fragmentary diagrammatic illustration light box employing a sign display in accordance with the present invention;

FIG. 2 is a front elevation, fragmentary view, of the light box of FIG. 1;

FIG. 3 is a diagrammatic illustration, similar to FIG. 2, of a plurality of the light boxes of FIG. 1 contiguously arranged to provide an integrated sign display;

BEST MODE FOR CARRYING OUT THE INVENTION

Figure 4:
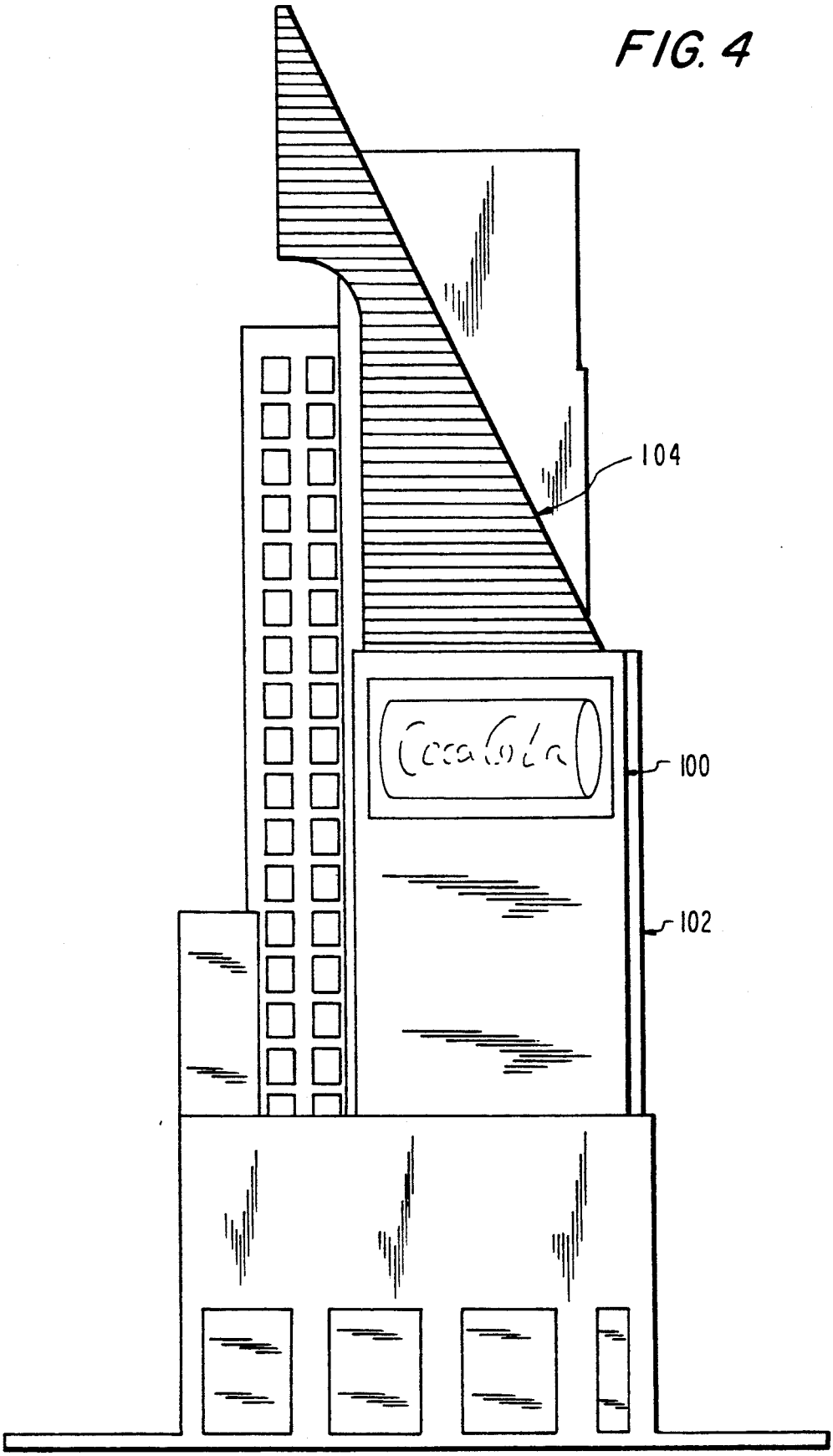
FIG. 4 is a diagrammatic illustration of the multi-media sign display of FIG. 1 mounted on the exterior of a building to provide an outdoor signage display which may be integrated with other signage mounted on the building showing the front lit reflective image as the only visually perceptible image.

Referring now to the drawings in detail, and initially to FIGS. 1 and 2, the multi-image sign display of the present invention, preferably comprises what is termed a trans/opaque matrix element 12 which preferably comprises a matrix system that combines both a reflective front image 14 and a transparent rear image 16 which are preferably combined into one layer such as by means of conventionally double-exposing photographic film-based material through a positive and a negative template in order to combine both images into a single layer. Preferably, both the front 14 and rear 16 images are preferably continuous tone photographic images, with the front image 14 being reflection photography and the rear image 16 being transparent photography. As shown and preferred in FIG. 1, both the front image 14 and rear image 16 are preferably segmented images which are divided into equal size image areas with the front reflective image areas 14 being interspersed between the transparent rear image areas 16 as shown and preferred by way of example in FIG. 1. In addition, as further shown and preferred, an opaque backing layer 18, such as preferably opaque white backing layer 18, is preferably provided behind each of the segmented front reflective image areas 14 so as to make the reflective image areas 14 photo-opaque and block light from the rear of these reflective image areas 14 while brightening the front reflective image 14. Preferably, the front reflective photographic image areas 14 have a photographic exposure which is at least 200% lighter than the photographic exposure of the rear transmissive photographic image areas 16. In addition, as shown and preferred in FIG. 1, the trans/opaque matrix element 12 of the present invention is preferably incorporated in a light box assembly 20 to provide a multi-image sign display having controllable illumination for varying the visible effects from the different scenes or images 14, 16 contained in the trans/opaque matrix 12. Consequently, as further shown in FIG. 1, preferably a rear or backlight illumination source 22 is provided in the light box assembly 20 and a front illumination source 24 is also preferably provided in front of the reflective image areas 14. If desired, light sources 22 and 24 may be the same type or may be different types, such as light source 24 being an incandescent light source, such as a halogen flood light, and with light source 22 being a neon light source. Of course, any desired combination of light sources 22 and 24 may be employed without departing from the present invention. In addition, it should be noted that front image areas 14 can be arranged for daylight viewing whereas rear image areas 16 can be arranged for night time viewing, such as a full on/full off effect, as well as the various effects possible by controlling light sources 22 and 24, such as a cross-dissolve effect in which the rear image 16 becomes visually perceptible through the front image 14 until all that can be seen is the rear image 16. Such a cross-dissolve effect is illustrated, by way of example in FIGS. 4–6.

As further shown and preferred in FIG. 1, a conventional white light diffuser 26 is preferably spaced apart from the transparent image areas 16 and is disposed between the rear of those transparent image areas 16 and the light source 22 so as to diffuse the light. Of course, if desired, light source 22 could also comprise a video wall. In the preferred example of FIG. 1, the front 14 and rear 16 segmented images comprise a film layer 28 which is applied to a glass substrate 30. One conventional manner of making this film layer 28 is to use a conventional Crosfield Design system, which is a computer designing station in which the front 14 and rear 16 images can be superimposed by means of a positive/negative template and combined into a transparency original of very high resolution. This high resolution transparency master representing one module can then be enlarged to its final display size by conventional photographic means. A separate, segmented, reflective layer, such as opaque white backing layer 18, is added to the backside of the area representing the reflective or front image 14 for proper reflective or opaque viewing. Desired neutral density, ultra violet and translucent filters can be added on an as needed basis. All the elements can then be sealed into a laminated sandwich package such as represented by glass substrate 30 and film layer 28, and then, together with separate diffusion substrate 26, be mounted into the light box 20. Preferably, the laminated sandwich 28–30, can be removed from the light box 20 so as to change the scenes to be displayed, with the first scene comprising the reflective image areas 14 and with a second scene comprising the transparent image areas 16. A plurality of different effects using these two scenes is possible by varying the illumination scheme of the light sources 22 and 24, such as under conventional computer control of the front and rear illumination sources 22 and 24. In addition, a plurality of light box assemblies 20 can be placed horizontally adjacent to each other, such as illustrated in FIG. 3 where twelve such assemblies **20*a*–20*l* are shown, to make a composite multi-image sign display. In such an instance, conventional computer control may be used to sequence all of the trans/opaque modules 20*a*–20*l*** comprising the sign display in a variety of patterns and at a desired time interval.

Figure 5:
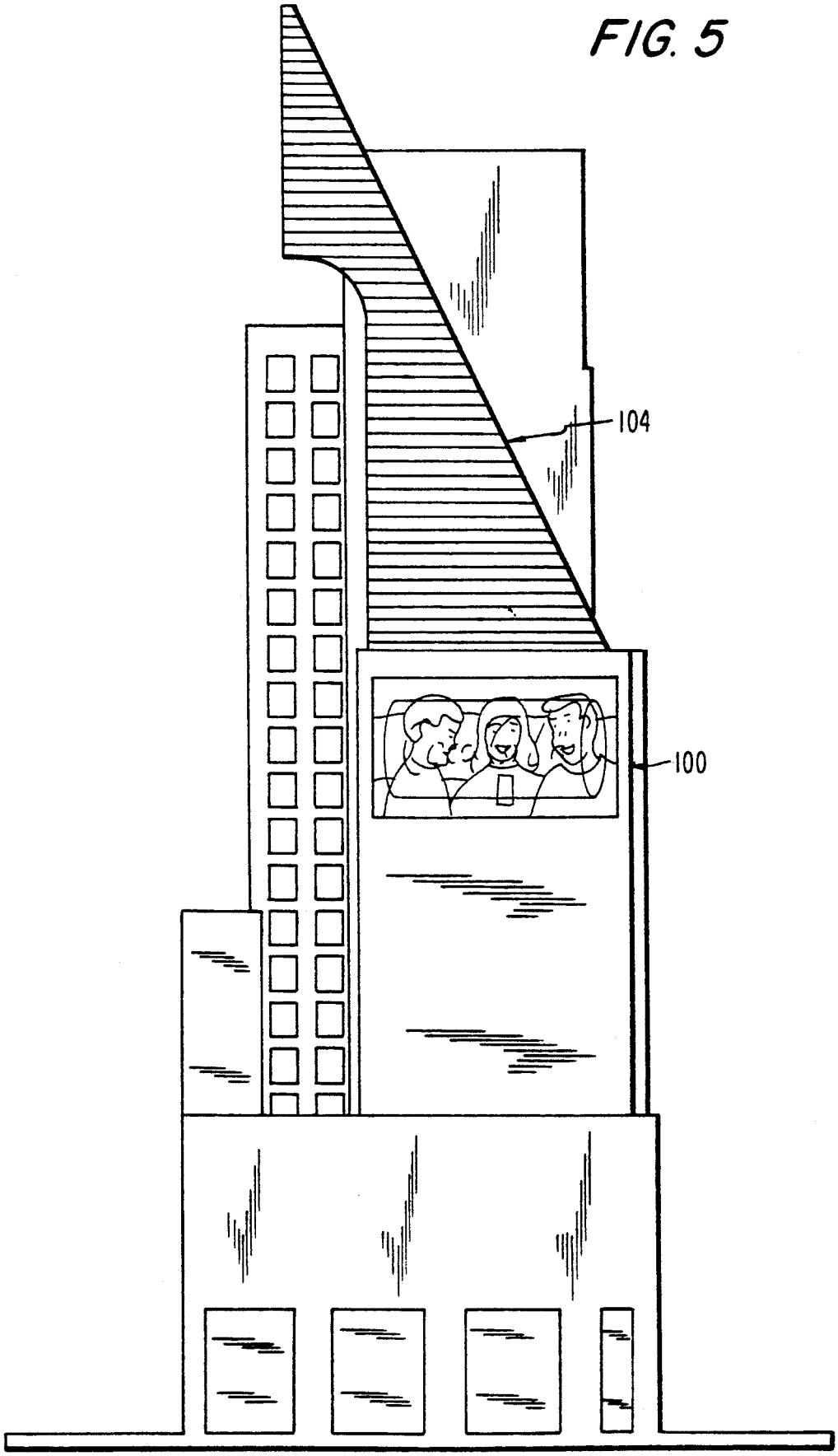
FIG. 5 is a diagrammatic illustration, similar to FIG. 4, illustrating a cross-dissolve effect for the multi-media sign display of FIG. 1 in which the backlit transmissive image is partially visually perceptible through the front lit reflective image of FIG. 4.
Figure 6:
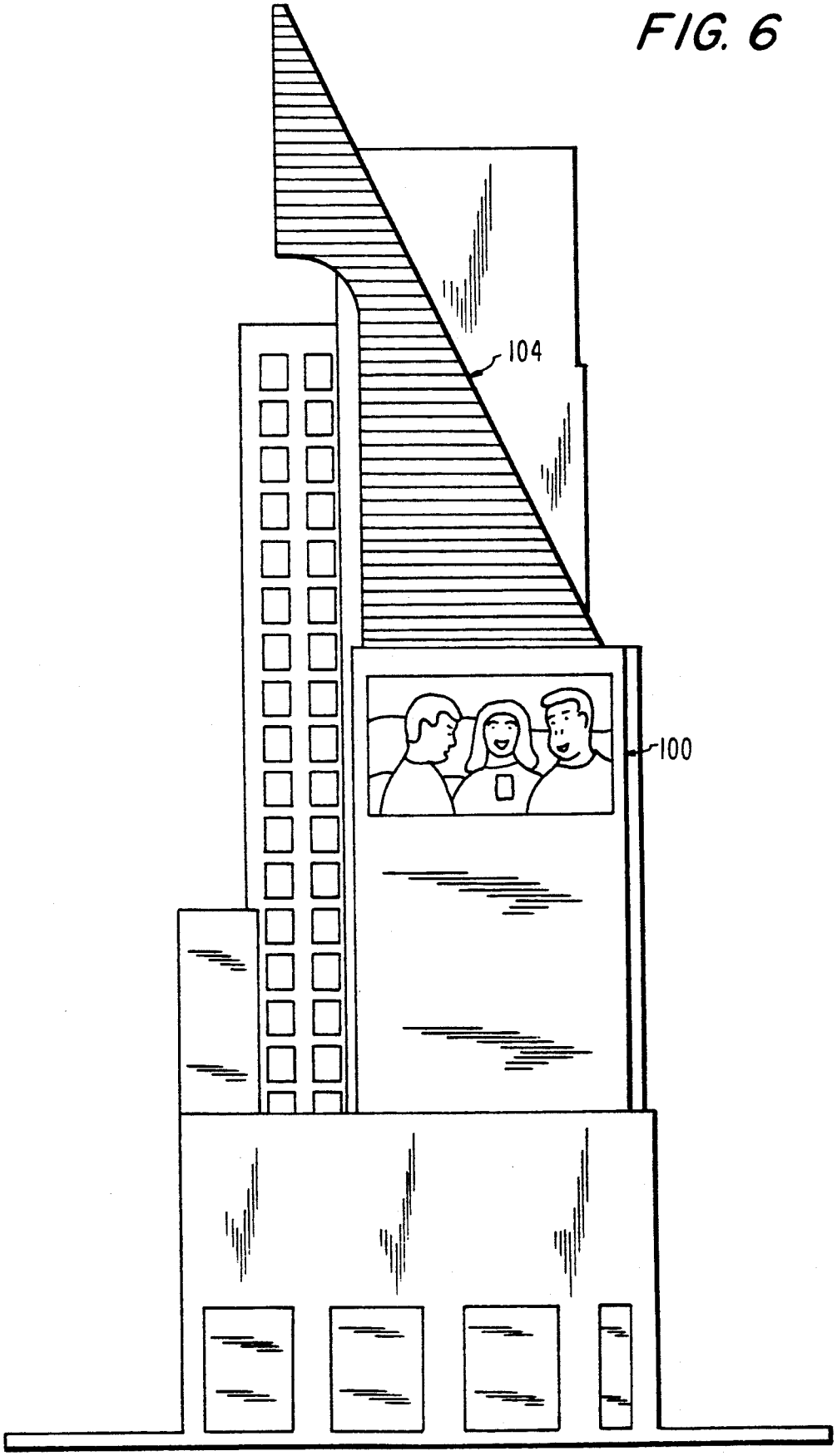
FIG. 6 is a diagrammatic illustration, similar to FIG. 4, in which the backlit transmissive image is now the only visually perceptible image.

As further shown and preferred in FIG. 2, which is a front elevation of the trans/opaque element 12 in FIG. 1, the trans/opaque matrix element 12 preferably comprises a vertically striped grid 32 in which the alternating vertical stripes comprise the transparent rear image areas 16 and the opaque backed front reflective image areas 14. Preferably, a typical light box assembly 20 such as a module of a light box assembly to be used on the exterior of a building to provide a multi-image sign display 100 such as illustrated in FIGS. 4–6, may comprise 176 vertical stripes of approximately ¼ inch each in width, 88 of which comprise transmissive image areas 16 and 88 of which comprise the opaque white backed reflective image areas 14, for an overall dimension for the light box 20 of approximately 44 inches by 44 inches. If twelve such modules 20 are horizontally arranged, as in FIG. 3, to provide sign display 100, then the composite display 100 would have a combined trans/opaque matrix element comprising 2,112 vertical stripes, half of which would comprise transmissive image areas 16 and half of which would comprise opaque white backed reflective image areas 14.

In producing the trans/opaque matrix element 12, one may preferably start with an 8 by 10 original transparency of a photographic image, preferably designed to meet proportions equal to a 2 to 1 ratio viewed right reading on the vertical axis. If desired, the photo composite may consist of logo art or some other graphic and typography. The composite art transparencies are then preferably converted into a scanned color corrected match print and the image is then preferably divided from top to bottom into three sections and a two inch by two inch hair line grid is preferably added to the composite art. The top and middle sections preferably produce 16 inch by 24 inch match prints, with the grid preferably dividing the prints into 96 equal parts each. The bottom section preferably produces a 14 inch by 24 inch match print and the grid preferably divides this print into 84 equal prints. When all three sections are combined, the gridded images will equal 276 parts. Each of the two inch by two inch areas of the 276 parts preferably represents a 44 inch by 44 inch light box assembly 20.

In selecting a film material 28 to create the trans/opaque matrix element 12 care should be taken to select a film material that has sufficient contrast, not too high or too low, and a base that is clear enough for the secondary, transparent image 16. It has been found that satisfactory results have been obtained with Fujichrome and Agfa clear, although other conventional film transparency materials may be employed. By way of example, it has been found that satisfactory results can be obtained if the overexposed photographic image 14 has been exposed at f8 for 7 seconds when the normally exposed image area 16 has been exposed at f8 for 2 seconds.

Referring once again to FIGS. 4–6, as was previously mentioned, the multi-image sign display 10 may be incorporated into a composite sign 100 mounted on the exterior of a building with the exterior of the building being represented by reference numeral 102 in FIG. 1. Of course, any desired programming arrangement of signs, such as the conventional vertical neon sign 104 illustrated in FIGS. 4–6, can be employed to determine how and when the various graphic images appear on the exterior of the building. Preferably, in the above example, as the sequence of neon sign area 104 ends, the multi image sign display area 100 which is comprised of the light box assembly 20 is controllably engaged. In the above example, the front lighting source 24 may be preferably first engaged to illuminate the reflective image areas 14 to expose the front photographic reflective image. As the desired conventional control programdictates, the front light source 24 will preferably be moved to a full off position as the rear illumination source 22 goes on, sequenced in a programmed checkerboard or other type of pattern which gradually exposes the second scene or photographic transmissive image areas 16 which are located on the trans/opaque matrix element 12 so that the second scene is viewable or visually perceptible through the first scene and may provide a variety of different visually perceptible effects dependent on the selective control of lighting sources 22 and 24, such as the aforementioned checkerboard effect, random patterning, a visually perceptible cross dissolve effect, a full on/full off effect, or a visually perceptible fade in/fade out effect. As previously mentioned, the visually perceptible cross dissolve effect is illustrated, by way of example, in FIGS. 4 through 6. As shown in FIG. 4, a full on effect for the first scene 14 in the above example, which is a scene representing a can of soft drink, is shown. In FIG. 5, the second scene 16, which is represented by a grouping of individuals, such as shown in FIG. 6, appears to dissolve through the first scene 14, with the visually perceptible cross dissolve being completed by what is shown in FIG. 6, with source 24 now full off and source 22 now full on, so that the second scene 16 is now seen through the first scene 14. In addition, as previously mentioned, the conventional control system may control the trans/opaque matrix 12 by computer control of the front 24 and rear 22 illumination and sequencing all trans/opaque modules 20*a*–20*l* in the matrix in a variety of patterns and at any desired time interval.

By utilizing the present invention, a multi image sign may be provided in which a plurality of different media effects, such as checkerboard, random patterning, visually perceptible cross dissolve, full on/full off and/or visually perceptible fade in/fade out effects may be provided by selective control of front and rear illumination with respect to two different scenes composed from continuous tone photographic images arranged on a light reflective and light transparent film media in a trans/opaque matrix, and may be readily changed by changing the panel on which these scenes are mounted. Thus, the system of the present invention provides enormous flexibility for providing illuminated graphic display messages restricted only by the imagination.

What is claimed is:

1. A multi-image sign display apparatus comprising a light transmitting substrate means having a front side and a rear side;

a film means having a front side and a rear side, said film means being contiguously disposed with respect to said light transmitting substrate means and comprising a first reflective image and a second transmissive image superimposed on said film means, said first reflective image comprising a front first scene image and said second transmissive image comprising a rear second scene image an opaque backing layer on said rear side disposed behind said first reflective image, said front first scene image comprising a plurality of spaced apart reflective image areas, said rear second scene image comprising a plurality of spaced apart transmissive image areas interspersed between said spaced apart reflective image areas, said opaque backing layer comprising a plurality of spaced apart opaque areas disposed behind said spaced apart reflective image areas;

illumination means for illuminating said film means from said front side for providing a reflective lighting condition for said film means for enabling a controllable display of said front first scene image and for controllably illuminating said film means from said rear side for providing a rear illumination lighting condition for said film means for enabling a controllable display of said rear second scene image visually perceptible through said front first scene image; and means for selectively controlling said illumination means for providing a plurality of different selectable media effects from said first and second scene images dependent on said lighting conditions.

2. A multi-image sign display apparatus in accordance with claim 1 wherein said opaque backing layer comprises an opaque white backing layer.

3. A multi-image sign display apparatus in accordance with claim 1 wherein said front first scene image reflective image areas and said rear second scene image transmissive image areas comprise a vertically striped grid.

4. A multi-image sign display apparatus in accordance with claim 3 wherein said reflective image area vertical strips are equal in number to said transmissive image area vertical stripes.

5. A multi-image sign display apparatus in accordance with claim 3 wherein said vertically striped grid comprises substantially equal width stripes for said front image reflective image areas and said rear image transmissive image areas.

6. A multi-image sign display apparatus in accordance with claim 5 wherein said reflective image area vertical strips are equal in number to said transmissive image area vertical stripes.

7. A multi-image sign display apparatus in accordance with claim 1 wherein said film means comprises a film transparency.

8. A multi-image sign display apparatus in accordance with claim 1 wherein said illumination means comprises a first controllable illumination means for illuminating said film means from said front side and a second controllable illumination means for illuminating said film means from said rear side.

9. A multi-image sign display apparatus in accordance with claim 8 further comprising a light diffuser means spaced apart from said film means rear side and disposed between said second controllable illumination means and said film means rear side.

10. A multi-image sign display apparatus in accordance with claim 9 wherein said light diffuser means comprises a white light diffuser.

11. A multi-image sign display apparatus in accordance with claim 10 wherein said light transmitting substrate means comprises a glass panel.

12. A multi-image sign display apparatus in accordance with claim 10 wherein said light transmitting substrate means comprises a plastic-type panel.

13. A multi-image sign display apparatus in accordance with claim 8 wherein said light transmitting substrate means comprises a glass panel.

14. A multi-image sign display apparatus in accordance with claim 8 wherein said light transmitting substrate means comprises a plastic-type panel.

15. A multi-image sign display apparatus in accordance with claim 8 wherein said plurality of different selectable media effects comprises a visually perceptible cross-dissolve effect.

16. A multi-image sign display apparatus in accordance with claim 8 wherein said plurality of different selectable media effects comprises a full on/full off effect.

17. A multi-image sign display apparatus in accordance with claim 8 wherein said first controllable illumination means comprises a halogen floodlight.

18. A multi-image sign display apparatus in accordance with claim 17 wherein said second controllable illumination means comprises neon illumination means.

19. A multi-image sign display apparatus in accordance with claim 8 wherein said second controllable illumination means comprises neon illumination means.

20. A multi-image sign display apparatus in accordance with claim 8 wherein said first controllable illumination means comprises an incandescent light source.

21. A multi-image sign display apparatus in accordance with claim 20 wherein said second controllable illumination means comprises neon illumination means.

22. A multi-image sign display apparatus in accordance with claim 8 wherein said apparatus comprises a light box assembly.

23. A multi-image sign display apparatus in accordance with claim 1 wherein said front image reflective image areas and said rear image transmissive image areas each comprise separate continuous tone photographic images.

24. A multi-image sign display apparatus in accordance with claim 1 wherein said light transmitting substrate means comprises a glass panel.

25. A multi-image sign display apparatus in accordance with claim 1 wherein said light transmitting substrate means comprises a plastic-type panel.

26. A multi-image sign display apparatus in accordance with claim 1 wherein said contiguously disposed film means is adhesively mounted to said light transmitting substrate means rear side.

27. A multi-image sign display apparatus in accordance with claim 26 wherein said light transmitting substrate means comprises a glass panel.

28. A multi-image sign display apparatus in accordance with claim 26 wherein said light transmitting substrate means comprises a plastic-type panel.

29. A multi-image sign display apparatus in accordance with claim 1 wherein said apparatus comprises a light box assembly.

30. A multi-image sign display apparatus in accordance with claim 8 wherein said front image reflective image areas and said rear image transmissive image areas each comprise separate continuous tone photographic images.

* * * * *